US011203036B1

(12) United States Patent
Lin et al.

(10) Patent No.: US 11,203,036 B1
(45) Date of Patent: Dec. 21, 2021

(54) DIP COATING APPARATUS

(71) Applicant: Acer Incorporated, New Taipei (TW)

(72) Inventors: Wen-Hsin Lin, New Taipei (TW); Tzu-Wei Lin, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 17/082,025

(22) Filed: Oct. 28, 2020

(30) Foreign Application Priority Data

May 27, 2020 (TW) ..... 109117598

(51) Int. Cl.
*B05C 3/09* (2006.01)
*B05C 13/00* (2006.01)
*B05C 11/06* (2006.01)

(52) U.S. Cl.
CPC ..... *B05C 3/09* (2013.01); *B05C 11/06* (2013.01); *B05C 13/00* (2013.01)

(58) Field of Classification Search
None
See application file for complete search history.

(56) References Cited

U.S. PATENT DOCUMENTS 1,750,807 A * 3/1930 Lichtman ..... C25D 17/08 204/297.1
2,258,391 A * 10/1941 Novitsky ..... C25D 17/08 204/297.1
2,512,554 A * 6/1950 Schneider ..... C25D 17/08 204/297.09
2,734,859 A * 2/1956 Reilly et al. ..... C25D 17/08 204/297.07
2,858,266 A * 10/1958 Schneider ..... C25D 17/08 204/297.09
3,029,952 A * 4/1962 Bagdon ..... B65G 17/20 211/117
3,429,786 A * 2/1969 Kubik ..... C25D 21/12 205/125
3,642,147 A * 2/1972 Voorhies ..... B05B 13/0264 211/57.1
3,785,952 A * 1/1974 Ritzenhoff ..... C25D 17/06 204/297.1
3,981,471 A * 9/1976 Currier ..... B65G 17/323 248/317

(Continued)

FOREIGN PATENT DOCUMENTS

| | | |
|---|---|---|
| CN | 205413517 | 8/2016 |
| CN | 107930978 | 4/2018 |
| JP | H07195004 | 8/1995 |

*Primary Examiner* — Jethro M. Pence
(74) *Attorney, Agent, or Firm* — JCIPRNET

(57) ABSTRACT

A dip coating apparatus includes a liquid tank containing paint and a hanging tool for dipping into or removal from the liquid tank. The hanging tool includes a hollow frame, a first and second rack, and two first hanging frames. The hollow frame has a first and second strip. The first and the second racks are disposed in the hollow frame and connected to the first and the second strips. Each of the first hanging frames includes a first top strip connected to the first rack, a first bottom strip connected to the second rack, and a first lateral strip connected to the first top strip and the first bottom strip. Each first lateral strip forms an obtuse angle with the corresponding first top strip and an acute angle with the corresponding first bottom strip. Each first lateral strip includes a first top hook and a first bottom hook.

20 Claims, 7 Drawing Sheets

(56) References Cited

U.S. PATENT DOCUMENTS 4,037,727 A * 7/1977 Kunkle ..... A47F 5/10 211/117
4,097,359 A * 6/1978 Davitz ..... B05B 5/082 118/500
4,217,853 A * 8/1980 Davitz ..... B05B 5/082 118/500
4,243,146 A * 1/1981 Davitz ..... B05C 13/00 118/500
4,628,859 A * 12/1986 Hines ..... B05B 5/082 118/500
4,679,526 A * 7/1987 Dziedzic ..... B05C 13/00 118/503
4,872,963 A * 10/1989 Van Horn ..... C25D 13/22 204/297.09
4,899,966 A * 2/1990 Antos ..... C25D 17/08 204/297.09
5,020,677 A * 6/1991 Wirth ..... A47F 5/08 118/500
5,084,155 A * 1/1992 Engwall ..... C25D 17/08 204/297.1
5,088,609 A * 2/1992 Frye ..... C25D 17/08 118/503
5,147,050 A * 9/1992 Cullen ..... B05B 5/082 118/500
5,524,774 A * 6/1996 Cullen ..... B05B 5/082 118/500
5,551,552 A * 9/1996 Ophardt ..... B05B 13/0221 198/465.1
5,598,099 A * 1/1997 Castleman ..... B05B 5/08 324/453
5,607,069 A * 3/1997 Stroobants ..... B05B 5/082 118/500
5,757,606 A * 5/1998 Westerberg ..... B05B 5/082 118/630
5,762,205 A * 6/1998 Davitz ..... B05B 5/082 211/117
5,776,554 A * 7/1998 Merritt ..... B05B 16/40 427/478
5,788,829 A * 8/1998 Joshi ..... C25D 17/06 204/230.2
5,824,403 A * 10/1998 Eidenschink ..... B29C 70/525 428/300.4
5,832,859 A * 11/1998 Sawyer ..... B63C 5/00 114/222
5,890,604 A * 4/1999 Heinz ..... B42F 11/00 211/46
5,897,709 A * 4/1999 Torefors ..... B05B 5/082 118/500
5,908,120 A * 6/1999 Yates ..... B05B 5/082 211/119
5,949,235 A * 9/1999 Castleman ..... G01R 31/50 324/509
6,189,709 B1 * 2/2001 Cullen ..... B05B 5/082 211/118
6,325,899 B1 * 12/2001 DeWent ..... B05B 5/082 118/500
6,564,441 B2 * 5/2003 Ibe ..... B23P 15/00 29/412
6,726,772 B2 * 4/2004 Owed, Jr. ..... B05B 5/082 118/500
8,215,502 B1 * 7/2012 Beavers ..... C25D 17/08 211/119
9,221,071 B2 * 12/2015 Huang ..... B05C 3/05
9,222,191 B2 * 12/2015 Wong ..... B05C 3/109
2002/0015798 A1 2/2002 DeWent
2012/0273439 A1 * 11/2012 Beavers ..... B05B 5/082 211/26
2013/0001073 A1 * 1/2013 Noda ..... B05C 3/10 204/275.1

* cited by examiner

DIP COATING APPARATUS

CROSS-REFERENCE TO RELATED APPLICATION

This application claims the priority benefit of Taiwan application serial no. 109117598, filed on May 27, 2020. The entirety of the above-mentioned patent application is hereby incorporated by reference herein and made a part of this specification.

BACKGROUND

Technical Field

This disclosure relates to a coating apparatus, and in particular to a dip coating apparatus.

Description of Related Art

In general, common workpieces (such as substrates or cabinets) are surface coated for aesthetic purpose or rust prevention. During surface coating, a workpiece is first dipped into a liquid tank containing paint, for the paint to be applied to a surface of the workpiece. After which, the workpiece is left to stand in the liquid tank for a period of time, before the workpiece is taken out of the liquid tank and left to stand above the liquid tank for a period of time, to allow the excess paint on the surface of the workpiece to drip back into the liquid tank. Finally, the paint solidifies on the surface of the workpiece and forms a coating film.

However, the current surface coating method has problems such as, for example, high occurrence of flow marks on the surface of the workpiece, uneven thickness of the coating film, or accumulation of paint at the bottom of the workpiece.

SUMMARY

An embodiment of the disclosure provides a dip coating apparatus that reduces unevenness in thickness of a coating film.

An embodiment of the disclosure provides a dip coating apparatus that includes a liquid tank and a hanging tool, wherein the liquid tank contains paint and the hanging tool is used for the dipping into or removal from the liquid tank. The hanging tool includes a hollow frame, a first rack, a second rack juxtaposed with the first rack, and two first hanging frames juxtaposed with each other. The hollow frame has a first strip and a second strip juxtaposed with the first strip. The first rack and the second rack are disposed in the hollow frame and are connected to the first strip and the second strip. Each of the first hanging frames includes a first top strip connected to the first rack, a first bottom strip connected to the second rack, and a first lateral strip connected to the first top strip and the first bottom strip. Each of the first lateral strips and the corresponding first top strip form an obtuse angle therebetween. Each of the first lateral strips and the corresponding first bottom strip form an acute angle therebetween. Each of the first lateral strips includes a first top hook and a first bottom hook.

Based on the above, in the dip coating apparatus of the disclosure, the hanging frame of the hanging tool is designed to be inclined to allow a workpiece to lean on the hanging frame. When the hanging tool is dipped into the liquid tank, the workpiece remains inclined to allow the paint to be evenly applied to a surface of the workpiece, therefore reducing unevenness in thickness of a coating film. When the hanging tool is removed from the liquid tank, the workpiece remains inclined to prevent excess paint from flowing down too quickly and resulting in flow marks on the surface of the workpiece.

To make the aforementioned more comprehensible, several embodiments accompanied with drawings are described in detail as follows.

DESCRIPTION OF THE EMBODIMENTS

Figure 1:
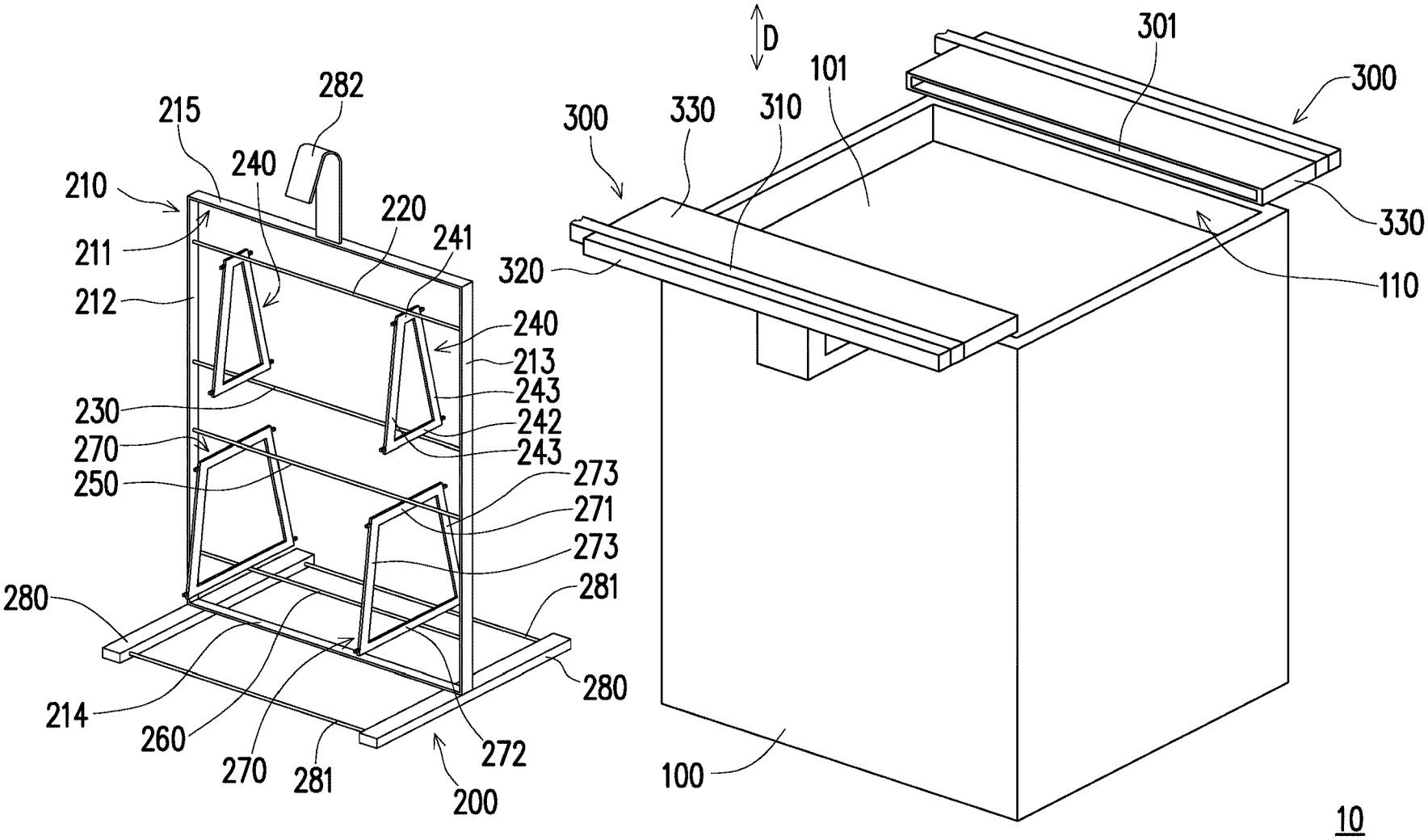
FIG. 1 is a schematic view of a dip coating apparatus according to an embodiment of the disclosure.
Figure 2:
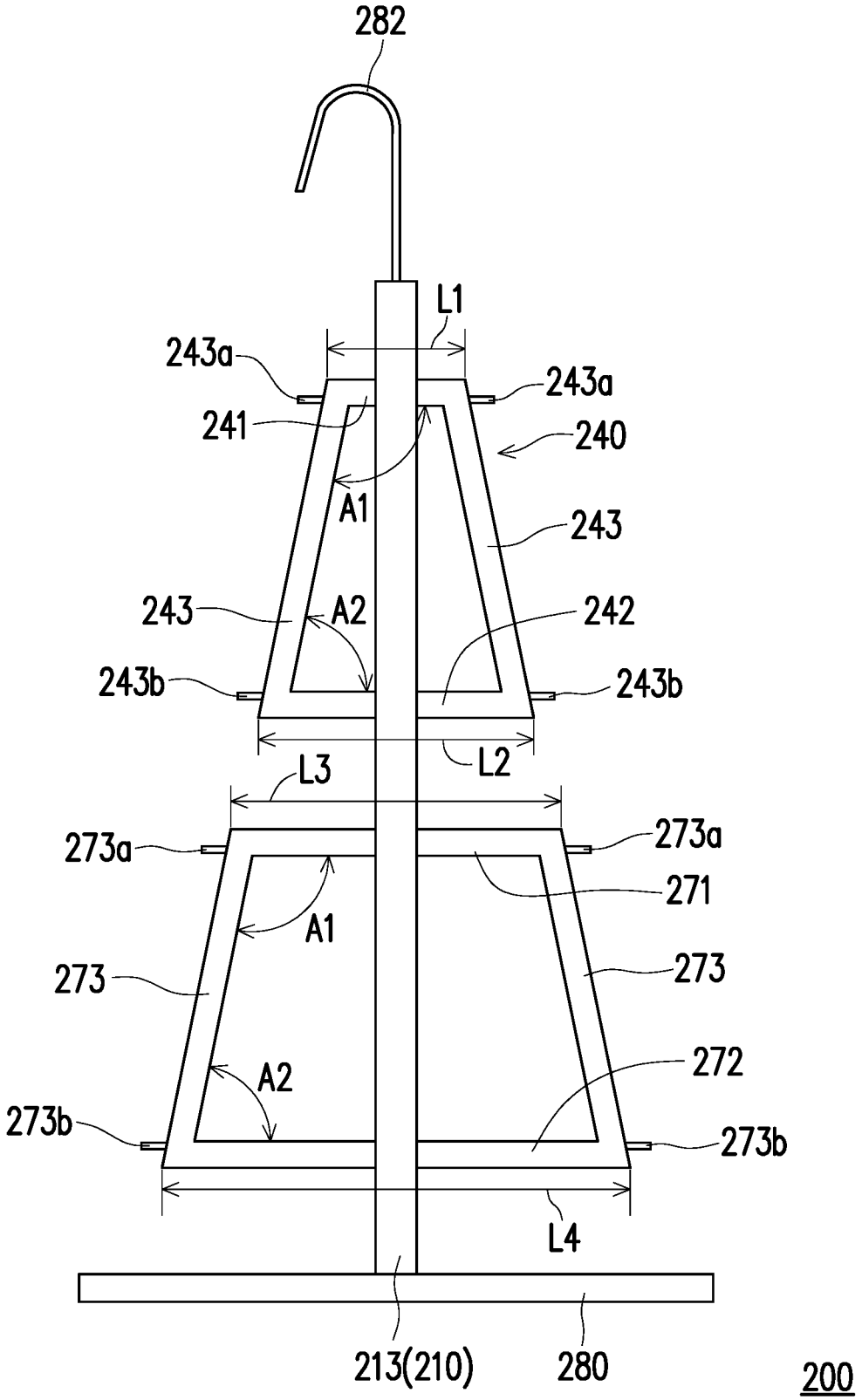
FIG. 2 is a schematic side view of the hanging tool in FIG. 1.
Figure 3:
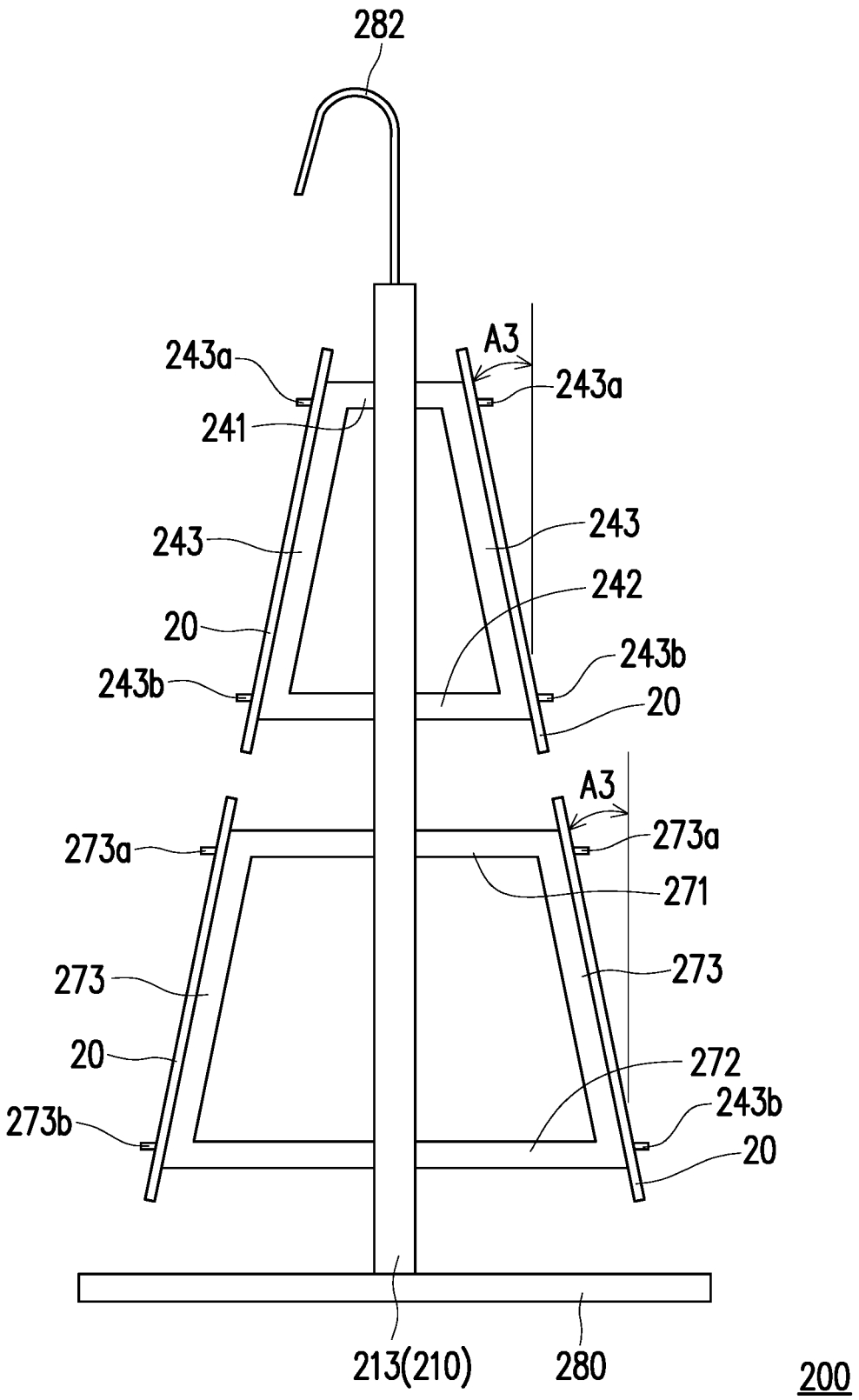
FIG. 3 is a schematic side view of the hanging tool in FIG. 2 hanging a workpiece.

FIG. 1 is a schematic view of a dip coating apparatus according to an embodiment of the disclosure. FIG. 2 is a schematic side view of the hanging tool in FIG. 1. FIG. 3 is a schematic side view of the hanging tool in FIG. 2 hanging a workpiece. Referring to FIGS. 1 to 3, in the present embodiment, a dip coating apparatus 10 includes a liquid tank 100 containing paint 101, and a hanging tool 200 used for dipping into or removal from the liquid tank 100, wherein the hanging tool 200 hangs a workpiece 20, and the workpiece 20 is dipped into or removed from the liquid tank 100 along with the hanging tool 200 to allow the paint 101 to be applied to a surface of the workpiece 20.

Figure 4:
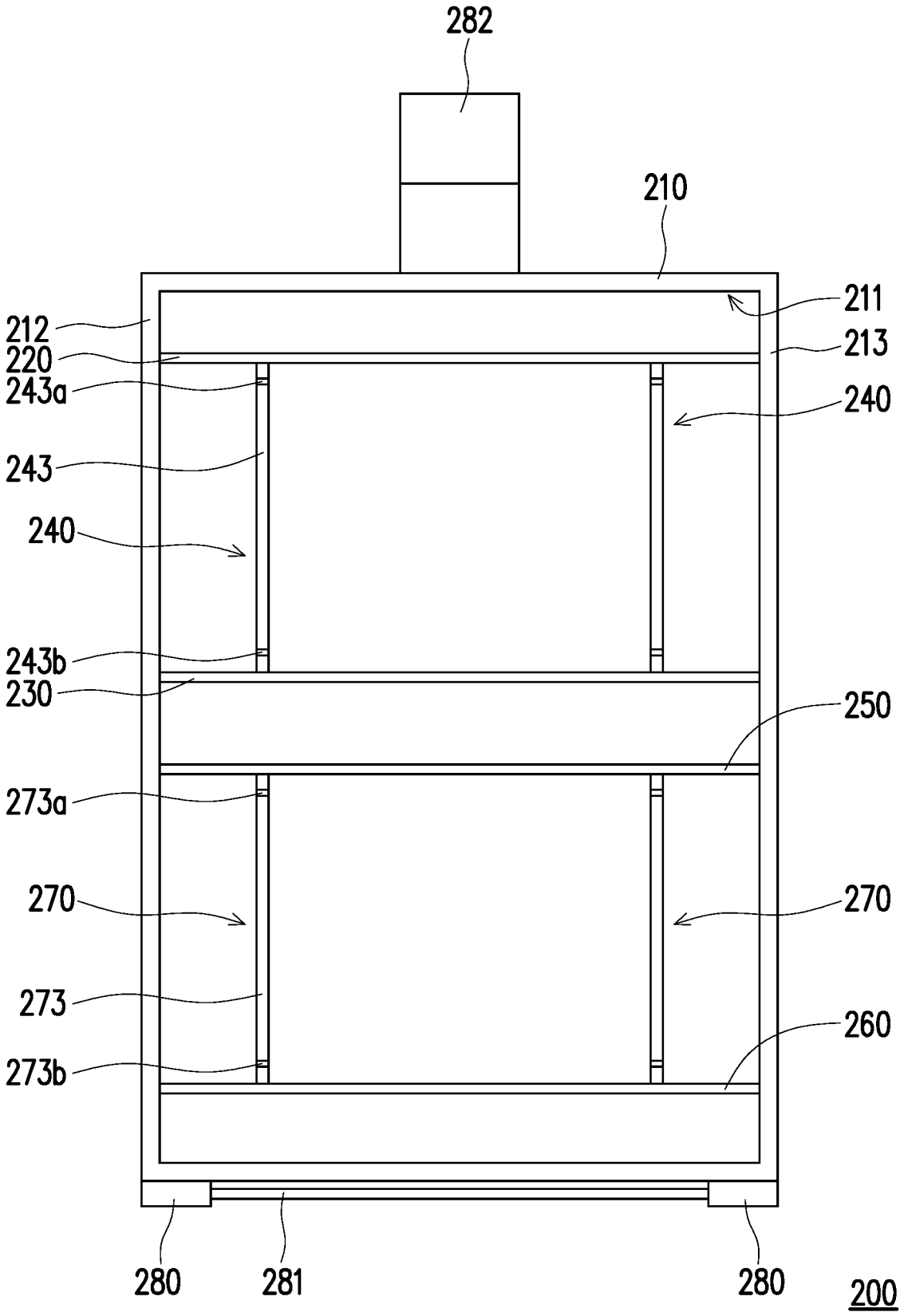
FIG. 4 is a schematic front view of the hanging tool in FIG. 1.
Figure 5:
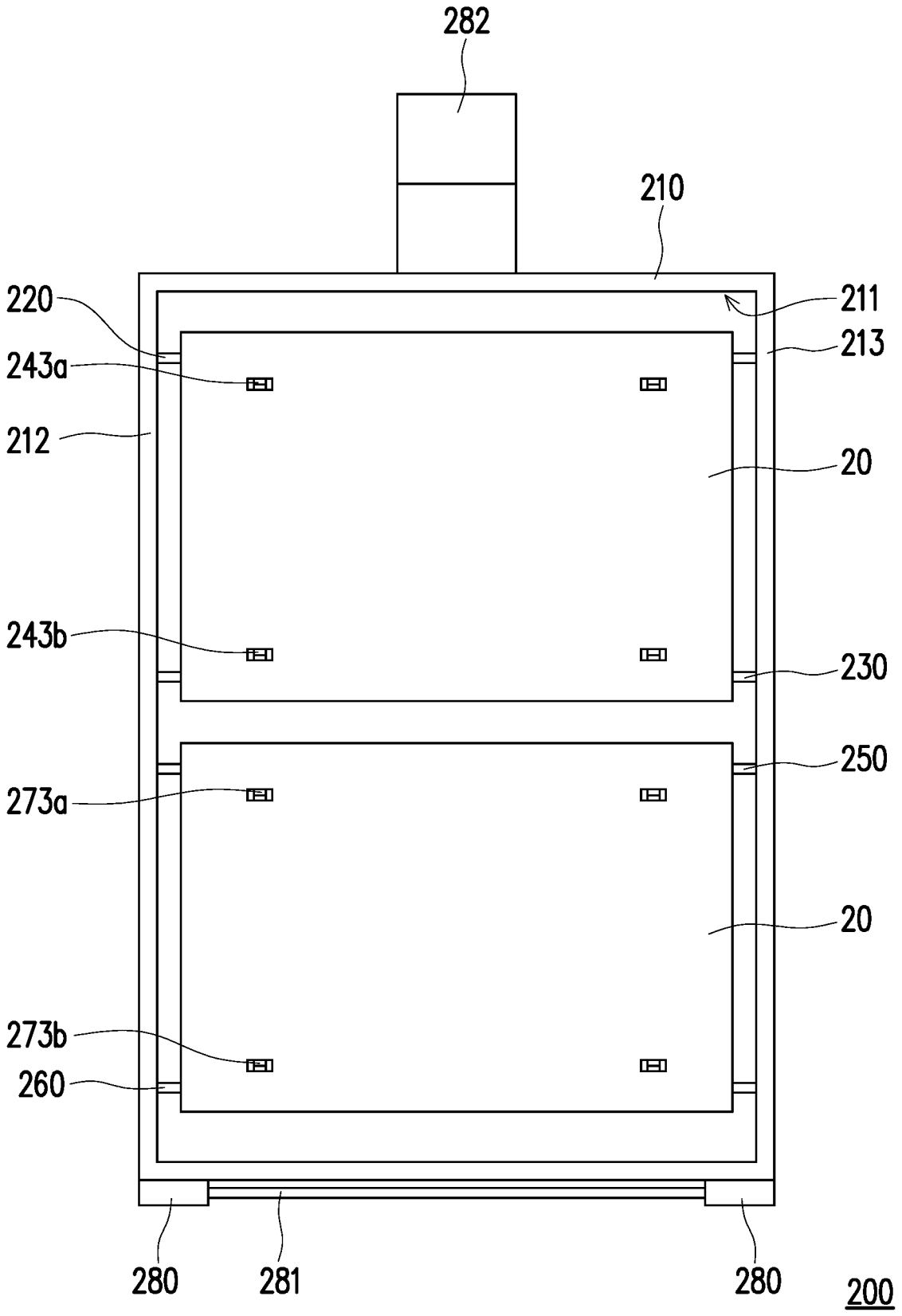
FIG. 5 is a schematic front view of the hanging tool in FIG. 4 hanging a workpiece.

FIG. 4 is a schematic front view of the hanging tool in FIG. 1. FIG. 5 is a schematic front view of the hanging tool in FIG. 4 hanging a workpiece. With reference to FIGS. 2, 4 and 5, the hanging tool 200 includes a hollow frame 210, a first rack 220, a second rack 230 juxtaposed with the first rack 220, and two first hanging frames 240 juxtaposed with each other. The hollow frame 210 may have a rectangular port 211, and the first rack 220 and the second rack 230 are disposed within the rectangular port 211. In addition, the hollow frame 210 has a first strip 212 and a second strip 213 juxtaposed with the first strip 212, wherein the first strip 212 is parallel to the second strip 213. Two ends of the first rack 220 are connected to the first strip 212 and the second strip 213 respectively, and two ends of the second rack 230 are connected to the first strip 212 and the second strip 213 respectively. The first rack 220 is parallel to the second rack 230, and the first rack 220 is perpendicular to the first strip 212 and the second strip 213.

The abovementioned two first hanging frames 240 are arranged symmetrically, and each of the first hanging frames 240 may be a trapezoidal hanging frame. Further, the two first hanging frames 240 are disposed between the first rack 220 and the second rack 230 and are arranged in parallel along a direction perpendicular to the first strip 212 or the second strip 213. Furthermore, each of the first hanging frames 240 includes a first top strip 241, a first bottom strip 242, and two first lateral strips 243, wherein the first top strip 241 is connected to the first rack 220, and the first bottom strip 242 is connected to the second rack 230. One of the two first lateral strips 243 is connected to one end of the first top strip 241 and one end of the first bottom strip 242, while the other of the two first lateral strips 243 is connected to the other end of the first top strip 241 and the other end of the first bottom strip 242.

The two first lateral strips 243 of each of the first hanging frames 240 are located outside the rectangular port 211 and are symmetrically disposed. The first top strip 241 extends outward from two opposite sides of the rectangular port 211, and the first bottom strip 242 extends outward from the two opposite sides of the rectangular port 211.

Referring to FIGS. 1 to 3, in the present embodiment, each of the first hanging frames 240 may be an isosceles trapezoidal hanging frame, wherein the first top strip 241 is parallel to the first bottom strip 242, and the two first lateral strips 243 are of the same length. The first top strip 241 has a first length L1, and the first bottom strip 242 has a second length L2 that is longer than the first length L1. Specifically, each of the first lateral strips 243 and the corresponding first top strip 241 form an obtuse angle A1 that is, for example, between 100 degrees and 120 degrees. Each of the first lateral strips 243 and the corresponding first bottom strip 242 form an acute angle A2 that is, for example, between 60 degrees and 80 degrees.

Each of the first lateral strips 243 includes a first top hook 243*a* and a first bottom hook 243*b*, wherein the first top hook 243*a* is close to the first top strip 241, and the first bottom hook 243*b* is close to the first bottom strip 242. Each workpiece 20 is hung on the first top hook 243*a* and the first bottom hook 243*b* of the corresponding first lateral strip 243 so as to be prevented from falling off due to gravity. In addition, due to the inclined design of each of the first lateral strips 243, each workpiece 20 leans against the corresponding first lateral strip 243, so that an angle A3 formed between the surface of each workpiece 20 and a direction D in which the hanging tool 200 is dipped into or removed from the liquid tank 100 is maintained between 10 degrees and 30 degrees.

Referring to FIGS. 2, 4 and 5, in the present embodiment, the hanging tool 200 further includes a third rack 250, a fourth rack 260 juxtaposed with the third rack 250, and two second hanging frames 270 juxtaposed with each other, wherein the third rack 250 and the fourth rack 260 are disposed within the rectangular port 211, and the third rack 250 is parallel to the fourth rack 260. Further, the second rack 230 is located between the first rack 220 and the third rack 250, and the third rack 250 is located between the second rack 230 and the fourth rack 260. In addition, two ends of the third rack 250 are connected to the first strip 212 and the second strip 213 respectively, and two ends of the fourth rack 260 are connected to the first strip 212 and the second strip 213 respectively. The first rack 220, the second rack 230, the third rack 250 and the fourth rack 260 are parallel to each other and perpendicular to the first strip 212 and the second strip 213.

The abovementioned two second hanging frames 270 are arranged symmetrically, and each of the second hanging frames 270 may be a trapezoidal hanging frame. Further, the two second hanging frames 270 are disposed between the third rack 250 and the fourth rack 260 and are arranged in parallel along a direction perpendicular to the first strip 212 or the second strip 213. Furthermore, each of the second hanging frames 270 includes a second top strip 271, a second bottom strip 272, and two second lateral strips 273, wherein the second top strip 271 is connected to the third rack 250, and the second bottom strip 272 is connected to the fourth rack 260. One of the two second lateral strips 273 is connected to one end of the second top strip 271 and one end of the second bottom strip 272, while the other of the two second lateral strips 273 is connected to the other end of the second top strip 271 and the other end of the second bottom strip 272.

The two second lateral strips 273 of each of the second hanging frames 270 are located outside the rectangular port 211 and are symmetrically disposed. The second top strip 271 extends outward from two opposite sides of the rectangular port 211, and the second bottom strip 272 extends outward from the two opposite sides of the rectangular port 211.

In the present embodiment, each of the second hanging frames 270 may be an isosceles trapezoidal hanging frame, wherein the second top strip 271 is parallel to the second bottom strip 272, and the two second lateral strips 273 are of the same length. The second top strip 271 has a third length L3 that is longer than the second length L2, and the second bottom strip 272 has a fourth length L4 that is longer than the third length L3. Specifically, each of the second lateral strips 273 and the corresponding second top strip 271 also form the obtuse angle A1, and each of the second lateral strips 273 and the corresponding second bottom strip 272 also form the acute angle A2.

Referring to FIGS. 1 to 3, each of the second lateral strips 273 includes a second top hook 273*a* and a second bottom hook 273*b*, wherein the second top hook 273*a* is close to the second top strip 271, and the second bottom hook 273*b* is close to the second bottom strip 272. Each workpiece 20 is hung on the second top hook 273*a* and the second bottom hook 273*b* of the corresponding second lateral strip 273 so as to be prevented from falling off due to gravity. In addition, due to the inclined design of each of the second lateral strips 273, each workpiece 20 leans against the corresponding second lateral strip 273, so that the angle A3 formed between the surface of each workpiece 20 and the direction D in which the hanging tool 200 is dipped into or removed from the liquid tank 100 is maintained between 10 degrees and 30 degrees.

In particular, the two first hanging frames 240 may be configured to hang at least two workpieces 20, and the two second hanging frames 270 may be configured to hang at least two workpieces 20. In addition, the first rack 220, the second rack 230, and the first hanging frame 240 are disposed as a group, while the third rack 250, the fourth rack 260, and the second hanging frame 270 are disposed as a group. In the present embodiment, the hanging tool 200 includes a two-layer hanging structure to hang multiple workpieces 20. In another embodiment, the hanging tool may include a single-layer hanging structure, such as including only the first rack, the second rack, and the first hanging frame, or including only the third rack, the fourth rack, and the second hanging frame.

As shown in FIGS. 2 and 3, the second length L2 of the first bottom strip 242 is shorter than the third length L3 of the second top strip 271, and the first lateral strip 243 and the second lateral strip 273 on the same side of the hollow frame 210 are parallel to each other. Therefore, a bottom end of the workpiece 20 hung on any of the first lateral strips 243 is misaligned with a top end of the workpiece 20 hung on any of the second lateral strips 273, or, in other words, in an orthographic projection direction or a gravity direction, the bottom end of the workpiece 20 hung on any of the first lateral strips 243 does not overlap the top end of the workpiece 20 hung on any of the second lateral strips 273. Therefore, when the paint drips from the workpiece 20 hung on any of the first lateral strips 243, the paint does not land onto the workpiece 20 hung on any of the second lateral strips 273.

Furthermore, in a horizontal direction, the top end of the workpiece 20 hung on any of the first lateral strips 243 is closer to the hollow frame 210 than the bottom end thereof, and the top end of the workpiece 20 hung on any of the second lateral strips 273 is closer to the hollow frame 210 than the bottom end thereof. On the other hand, the bottom end of the workpiece 20 hung on any of the first lateral strips 243 is closer to the hollow frame 210 than the top end of the workpiece 20 hung on any of the second lateral strips 273.

As shown in FIG. 5, each workpiece 20 has a plurality of perforations for the first top hook 243*a* and the first bottom hook 243*b* to pass through, or for the second top hook 273*a* and the second bottom hook 273*b* to pass through.

With reference to FIG. 1, in the present embodiment, the hanging tool 200 further includes two bases 280 juxtaposed with each other, two cross bars 281 juxtaposed with each other, and a hook 282, wherein the two bases 280 are parallel to each other, and are connected to a bottom 214 of the hollow frame 210. The two cross bars 281 are parallel to each other and perpendicular to the two bases 280. The two cross bars 281 are located between the two bases 280, wherein the two cross bars 281 are located on two opposite sides of the hollow frame 210, and two ends of each of the cross bars 281 are connected to the two bases 280 respectively.

During the dipping of the hanging tool 200 into the liquid tank 100, the two cross bars 281 may break liquid surface tension of the paint 101 to enable smooth dipping of the workpiece 20 into the paint 101 in the liquid tank 100. On the other hand, the hook 282 is connected to a top 215 of the hollow frame 210 to facilitate grasping of the hanging tool by an instrument or an operator.

Figure 6:
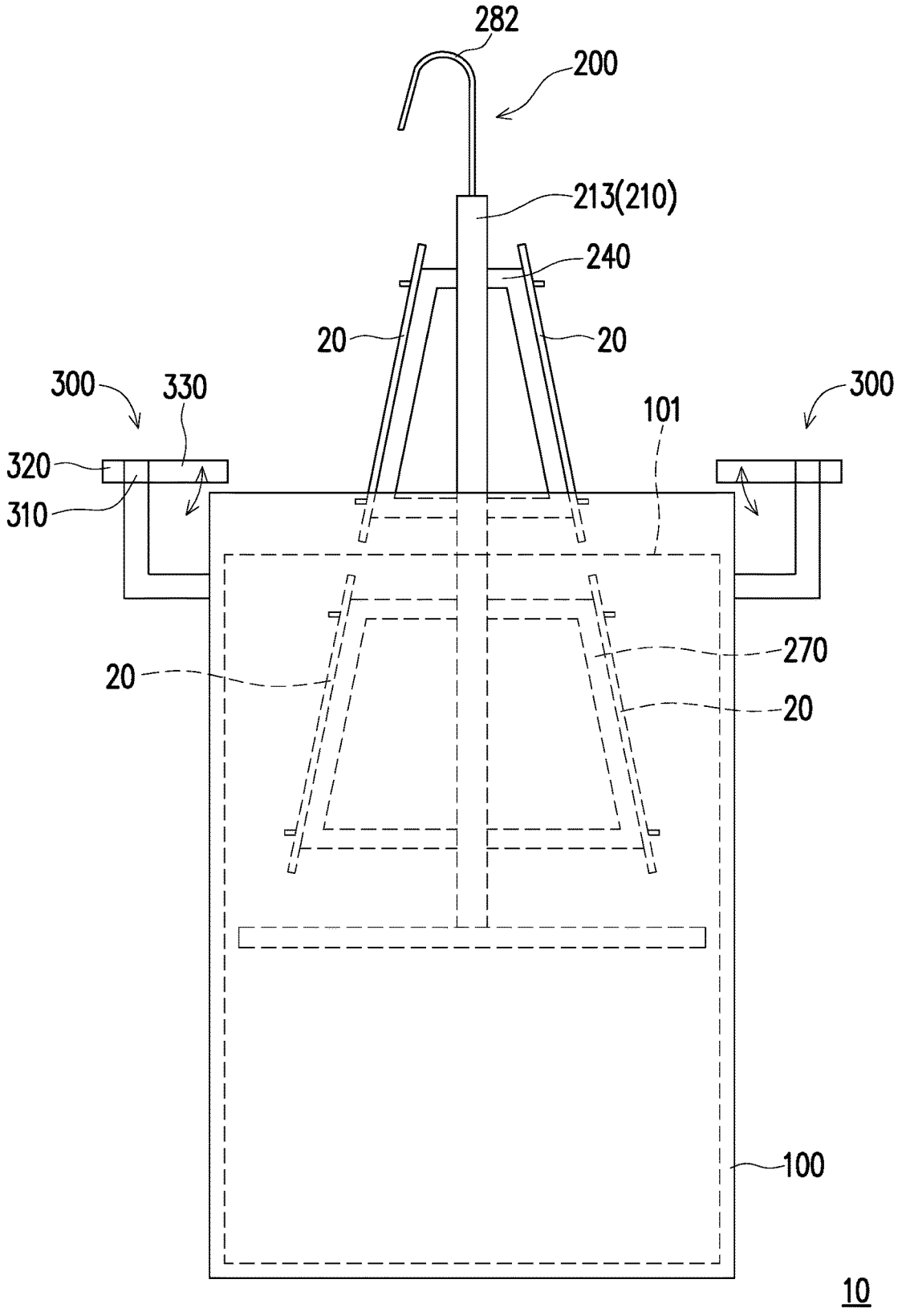
FIG. 6 is a schematic side view of the hanging tool in FIG. 1 being dipped into or removed from a liquid tank.

FIG. 6 is a schematic side view of the hanging tool in FIG. 1 being dipped into or removed from a liquid tank. Referring to FIGS. 1 and 6, in the present embodiment, the dip coating apparatus 10 further includes a blower 300 installed outside the liquid tank 100, wherein the liquid tank 100 has an opening 110, and an outlet 301 of the blower 300 is disposed corresponding to the opening 110. Furthermore, the number of the blower 300 is two, and the two blowers 300 are disposed on two opposite sides of the opening 110 to provide airflow to the surface of workpiece 20 hung on the hanging tool 200.

Specifically, the blower 300 includes an air inlet pipe 310, a temperature controller 320, and an air outlet pipe 330, wherein the temperature controller 320 is thermally coupled to the air inlet pipe 310, to regulate the temperature of the airflow flowing through the air inlet pipe 310 so as to maintain the temperature of the airflow between 10 degrees Celsius and 40 degrees Celsius. In addition, the air inlet pipe 310 communicates with the air outlet pipe 330, wherein the outlet 301 is located at the air outlet pipe 330, and the air outlet pipe 330 is disposed corresponding to the opening 110. Therefore, the airflow is blown out of the outlet 301 at the air outlet pipe 330 and toward the opening 110 so as to blow the surface of the workpiece 20 hung on the hanging tool 200.

When the hanging tool 200 is removed from the liquid tank 100, the blower 300 provides the airflow to the surface of the workpiece 20 to smoothen the paint on the surface of the workpiece 20 and improve the evenness of the paint applied to the surface of the workpiece 20, or, alternatively, to remove excess paint on the surface of the workpiece 20, and prevent the paint from accumulating on the bottom of the workpiece 20. Finally, the excess paint dripping from the workpiece 20 may be recycled into the liquid tank 100 to avoid a waste of paint. On the other hand, as the temperature of the airflow is maintained between 10 degrees Celsius and 40 degrees Celsius, viscosity of the paint blown by the airflow is unlikely to increase, therefore avoiding a situation where the paint flows too slow and accumulates on the surface of the workpiece 20.

In particular, an air outlet range of the outlet 301 covers a vertical depth or horizontal depth of the opening 110 to ensure that the entire surface of the workpiece 20 is blown by the airflow. In addition, the air outlet pipe 330 has a degree of freedom of rotation and adjusts a blowing direction accordingly. For example, the air outlet pipe 330 may be maintained in a horizontal position or be rotated downward within about 30 degree from the horizontal position. In addition, the blowing direction is preferably perpendicular to the surface of the workpiece 20.

Referring to FIGS. 1 to 3 and 6, when the hanging tool 200 is dipped into the liquid tank 100, the workpiece 20 remains inclined, so that the paint 101 is evenly applied to the surface of the workpiece 20, therefore reducing unevenness in thickness of a coating film. When the hanging tool 200 is removed from the liquid tank 100, the workpiece 20 remains inclined to prevent excess paint from flowing down too quickly and resulting in flow marks on the surface of the workpiece 20. In addition, since the workpieces 20 in the upper layer and lower layer are misaligned with each other, the paint dripping from the workpiece 20 in the upper layer does not land onto the workpiece 20 in the lower layer.

Figure 7:
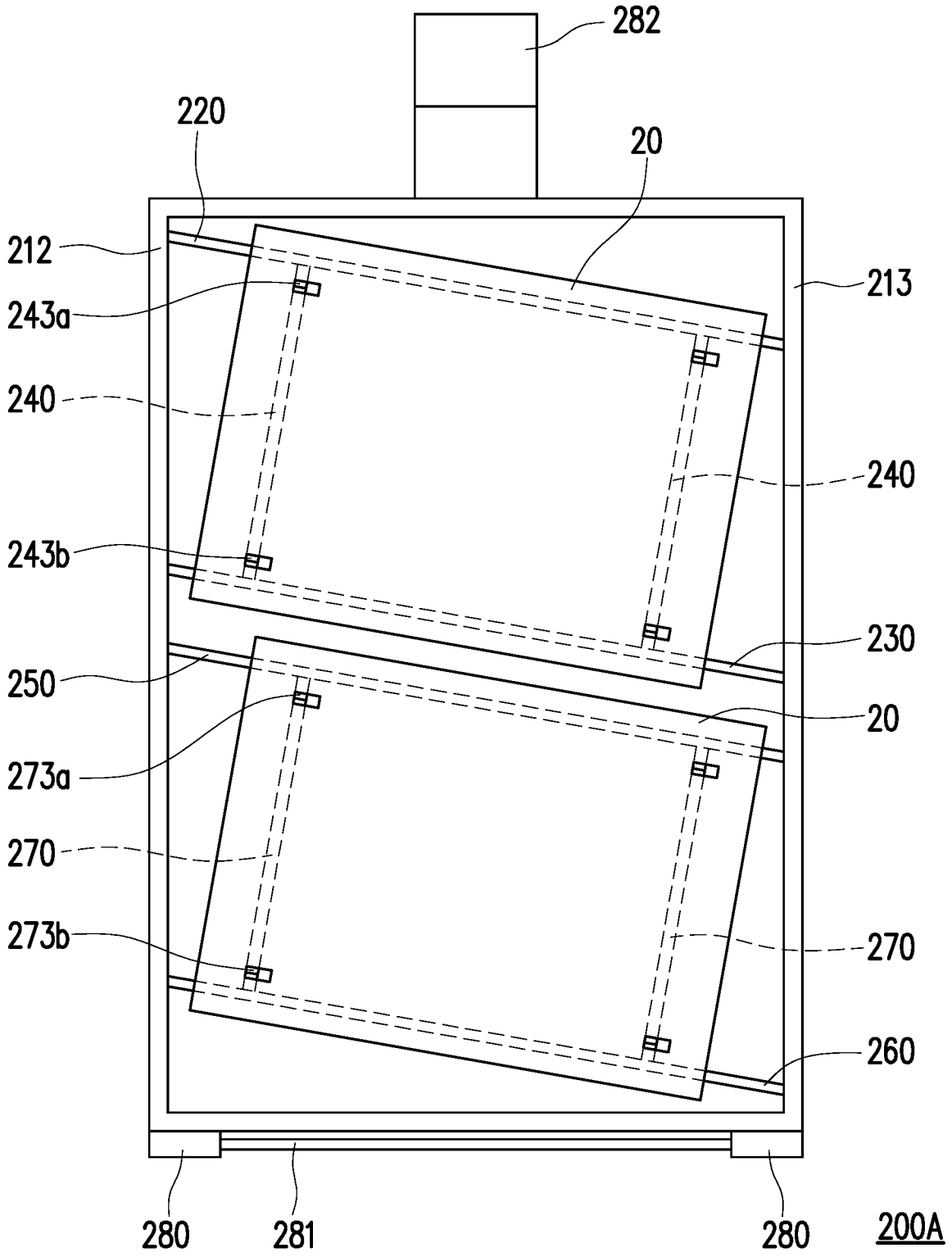
FIG. 7 is a schematic front view of a hanging tool hanging a workpiece according to another embodiment of the disclosure.

FIG. 7 is a schematic front view of a hanging tool hanging a workpiece according to another embodiment of the disclosure. With reference to FIG. 7, compared to the hanging tool 200 in FIG. 3, in a hanging tool 200A of the present embodiment, the first rack 220, the second rack 230, the third rack 250, and the fourth rack 260 are parallel to each other, and inclined to the first strip 212 and the second strip 213. In other words, an angle formed by any of the first rack 220, the second rack 230, the third rack 250 and the fourth rack 260 with the first strip 212 or the second strip 213 is greater than or less than 90 degrees.

Furthermore, one of the two first hanging frames 240 is higher than the other of the two first hanging frames 240, and one of the two second hanging frames 270 is higher than the other of the two second hanging frames 270. As the workpiece 20 hung on the two first hanging frames 240 or the two second hanging frames 270 is in an inclined state, when the hanging tool 200A is removed from the liquid tank 100 (refer to FIG. 1), excess paint is likely to flow to a lowest corner in the workpiece 20.

In summary, in the dip coating apparatus of the disclosure, the hanging frame of the hanging tool is designed to be inclined to allow a workpiece to lean on the hanging frame. Therefore, when the hanging tool is dipped into the liquid tank, the workpiece remains inclined to allow the paint to be evenly applied to the surface of the workpiece, therefore avoiding uneven thickness of the coating film. When the hanging tool is removed from the liquid tank, the workpiece remained inclined to avoid excess paint from flowing down too quickly and resulting in flow marks on the surface of the workpiece. In addition, the dip coating apparatus of the disclosure has incorporated a blower. Therefore, when the hanging tool is removed from the liquid tank, the blower blows airflow to the surface of the workpiece to smoothen the paint on the surface of the workpiece and improve the evenness of the paint applied to the surface of the workpiece, or, to remove excess paint from the surface of the workpiece, and prevent the accumulation of paint on the bottom of the workpiece. Finally, the excess paint dripped from the workpiece is recycled into the liquid tank to avoid a waste of paint.

Although the disclosure has been described with reference to the abovementioned embodiments, it is not intended to be exhaustive or to limit the disclosure to the precise form or to exemplary embodiments disclosed. It is apparent to one of ordinary skill in the art that modifications to the described embodiments may be made without departing from the spirit and the scope of the disclosure. Accordingly, the scope of the disclosure is defined by the claims appended hereto and their equivalents in which all terms are meant in their broadest reasonable sense unless otherwise indicated.

What is claimed is:

1. A dip coating apparatus, comprising:

a liquid tank containing paint; and a hanging tool for dipping into or removal from the liquid tank, comprising:

a hollow frame, comprising a first strip and a second strip juxtaposed with the first strip;

a first rack disposed in the hollow frame and connected to the first strip and the second strip;

a second rack juxtaposed with the first rack, disposed in the hollow frame and connected to the first strip and the second strip; and two first hanging frames juxtaposed with each other, each of the first hanging frames comprising a first top strip connected to the first rack, a first bottom strip connected to the second rack, and a first lateral strip connected to the first top strip and the first bottom strip, wherein each of the first lateral strips and the corresponding first top strip form an obtuse angle therebetween, each of the first lateral strips and the corresponding first bottom strip form an acute angle therebetween, and each of the first lateral strips comprises a first top hook and a first bottom hook.

2. The dip coating apparatus according to claim 1, wherein the first rack is parallel to the second rack.

3. The dip coating apparatus according to claim 2, wherein the first rack is perpendicular to the first strip and the second strip.

4. The dip coating apparatus according to claim 2, wherein the first rack is inclined to the first strip and the second strip.

5. The dip coating apparatus according to claim 1, wherein the first top strip of each of the first hanging frames has a first length, and the first bottom strip has a second length longer than the first length.

6. The dip coating apparatus according to claim 1, wherein the obtuse angle formed between each of the first lateral strips and the corresponding first top strip is between 100 degrees and 120 degrees.

7. The dip coating apparatus according to claim 1, wherein the acute angle formed between each of the first lateral strips and the corresponding first bottom strip is between 60 degrees and 80 degrees.

8. The dip coating apparatus according to claim 1, wherein each of the first hanging frames is a trapezoidal hanging frame.

9. The dip coating apparatus according to claim 1, wherein the hanging tool further comprises:

two bases juxtaposed with each other and connected to a bottom of the hollow frame;

two cross bars juxtaposed with each other, located between the two bases and connected to the two bases, wherein the two cross bars are located on two opposite sides of the hollow frame; and a hook connected to a top of the hollow frame.

10. The dip coating apparatus according to claim 9, wherein the two cross bars are parallel to the first rack and the second rack.

11. The dip coating apparatus according to claim 1, wherein the hanging tool further comprises:

a third rack disposed in the hollow frame, wherein the third rack is connected to the first strip and the second strip, and the second rack is located between the first rack and the third rack;

a fourth rack juxtaposed with the third rack, disposed in the hollow frame, wherein the fourth rack is connected to the first strip and the second strip, and the third rack is located between the second rack and the fourth rack; and two second hanging frames juxtaposed with each other, each of the second hanging frames comprising a second top strip connected to the third rack, a second bottom strip connected to the fourth rack, and a second lateral strip connected to the second top strip and the second bottom strip, wherein each of the second lateral strips and the corresponding second top strip form an obtuse angle therebetween, each of the second lateral strips and the corresponding second bottom strip form an acute angle therebetween, and each of the second lateral strips comprises a second top hook and a second bottom hook.

12. The dip coating apparatus according to claim 11, wherein the first rack, the second rack, the third rack, and the fourth rack are parallel to each other.

13. The dip coating apparatus according to claim 12, wherein the first rack is perpendicular to the first strip and the second strip.

14. The dip coating apparatus according to claim 12, wherein the first rack is inclined to the first strip and the second strip.

15. The dip coating apparatus according to claim 11, wherein the first top strip of each of the first hanging frames has a first length, and the first bottom strip has a second length longer than the first length, the second top strip of each of the second hanging frames has a third length longer than the second length, and the second bottom strip has a fourth length longer than the third length.

16. The dip coating apparatus according to claim 11, wherein the obtuse angle formed between each of the second lateral strips and the corresponding second top strip is between 100 degrees and 120 degrees.

17. The dip coating apparatus according to claim 11, wherein the acute angle formed between each of the second lateral strips and the corresponding second bottom strip is between 60 degrees and 80 degrees.

18. The dip coating apparatus according to claim 11, wherein each of the second hanging frames is a trapezoidal hanging frame.

19. The dip coating apparatus according to claim 1, further comprising a blower installed at the liquid tank, wherein the liquid tank has an opening, and an outlet of the blower is disposed corresponding to the opening.

20. The dip coating apparatus according to claim 19, wherein the blower comprises an air inlet pipe, a temperature controller, and an air outlet pipe, the temperature controller is thermally coupled to the air inlet pipe, the air inlet pipe communicates with the air outlet pipe, and the outlet of the blower is located at the air outlet pipe.

* * * * *